US008918024B2

(12) United States Patent
Saito et al.

(10) Patent No.: US 8,918,024 B2
(45) Date of Patent: Dec. 23, 2014

(54) DEVELOPMENT DEVICE

(75) Inventors: Kazuhiro Saito, Hachioji (JP); Junji Murauchi, Toyokawa (JP); Tomohiro Kato, Okazaki (JP); Tetsuya Kagawa, Toyokawa (JP); Hiroaki Takada, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 90 days.

(21) Appl. No.: 13/527,202

(22) Filed: Jun. 19, 2012

(65) Prior Publication Data

US 2012/0321355 A1 Dec. 20, 2012

(30) Foreign Application Priority Data

Jun. 20, 2011 (JP) ..... 2011-136378

(51) Int. Cl.
*G03G 15/08* (2006.01)
*G03G 15/09* (2006.01)

(52) U.S. Cl.
CPC ..... *G03G 15/0893* (2013.01); *G03G 15/09* (2013.01)
USPC ..... 399/254; 399/258; 399/262

(58) Field of Classification Search
USPC ..... 399/111, 119, 254, 265, 258, 222, 262, 399/263
See application file for complete search history.

(56) References Cited

U.S. PATENT DOCUMENTS 5,175,587 A * 12/1992 Kato et al. ..... 399/262
5,722,002 A * 2/1998 Kikuta et al. ..... 399/30
7,263,315 B2 * 8/2007 Tanaka et al. ..... 399/254
2011/0052268 A1 * 3/2011 Mano et al. ..... 399/262
2011/0150535 A1 * 6/2011 Murauchi et al. ..... 399/254

FOREIGN PATENT DOCUMENTS

JP 2000293025 A 10/2000
JP 2006-47884 2/2006
JP 2006-113407 4/2006
JP 2011-2760 1/2011

OTHER PUBLICATIONS

Notification of Reasons for Refusal mailed Aug. 13, 2013, directed to Japanese Application No. 2011-136378; 5 pages.
Japanese Office Action dated Apr. 1, 2014 in counterpart Japanese Application No. 2011-136378.

* cited by examiner

*Primary Examiner* — Francis Gray
(74) *Attorney, Agent, or Firm* — Holtz, Holtz, Goodman & Chick PC

(57) ABSTRACT

A development device having: a main unit having formed therein a first space and a second space extending in a first direction perpendicular to a vertical direction, a first communicating portion and a second communicating portion that allow the first space and the second space to communicate with each other at both ends in the first direction; a first stirring member that extends in the first direction within the first space; a second stirring member that is positioned within the first space between the first stirring member and the second space and extends in the first direction; a conveyance member that extends in the first direction within the second space; and a developer support member that extends in the first direction within the second space.

15 Claims, 6 Drawing Sheets

DEVELOPMENT DEVICE

This application is based on Japanese Patent Application No. 2011-136378 filed on Jun. 20, 2011, the content of which is incorporated herein by reference.

BACKGROUND OF THE INVENTION

1. Field of the Invention

The present invention relates to development devices, particularly to a development device that forms a toner image using a developer including toner and carrier.

2. Description of Related Art

As a conventionally general development device, for example, a development device described in Japanese Patent Laid-Open Publication No. 2011-2760 is known. FIG. 7 is a cross-sectional view of the development device 500 described in Japanese Patent Laid-Open Publication No. 2011-2760. FIG. 8 is a top view of the development device 500 described in Japanese Patent Laid-Open Publication No. 2011-2760. In the following, the vertical direction is defined as a z-axis direction, the longitudinal direction of the development device 500 as an x-axis direction, and a direction perpendicular to the x-axis direction and the z-axis direction as a y-axis direction.

The development device 500 includes a housing 502, stirring screws 504 and 506, a conveying screw 508, and a developing roller 510. The housing 502 has formed therein a developer stirring portion Sp11, a developer supply and recovery portion Sp12, and communicating portions R11 and R12. The developer stirring portion Sp11 and the developer supply and recovery portion Sp12 communicates with each other at both ends via the communicating portions R11 and R12.

The stirring screws 504 and 506 extend in the x-axis direction within the developer stirring portion Sp11, and convey a developer in the positive x-axis direction. The developer conveyed by the stirring screws 504 and 506 flows into the developer supply and recovery portion Sp12 via the communicating portion R11.

The conveying screw 508 extends in the x-axis direction within the developer supply and recovery portion Sp12, and conveys the developer in the negative x-axis direction. The developer conveyed by the conveying screw 508 flows into the developer stirring portion Sp11 via the communicating portion R12.

The developing roller 510 is provided in the developer supply and recovery portion Sp12, and supports the developer being conveyed by the conveying screw 508, on the periphery.

In the development device 500 thus configured, the developer is sequentially conveyed and circulated through the developer stirring portion Sp11, the communicating portion R11, the developer supply and recovery portion Sp12, and the communicating portion R12, in the same order.

Incidentally, the development device 500 might have uneven density in a toner image. More specifically, there might be an insufficient amount of developer flowing from the communicating portion R11 into the developer supply and recovery portion Sp12. In such a case, a sufficient amount of developer can be supported in the vicinity of an end of the developing roller 510 on the positive x-axis direction side but cannot be supported in the vicinity of an end of the developing roller 510 on the negative x-axis direction side. As a result, uneven density might occur in a toner image developed on a photoreceptor by the developing roller 510.

SUMMARY OF THE INVENTION

A development device according to an embodiment of the present invention includes: a main unit having a developer stored therein and having formed therein a first space extending in a first direction perpendicular to a vertical direction, a second space adjacent to the first space and extending in the first direction, a first communicating portion that allows the first space and the second space to communicate at an end of the second space in the first direction, and a second communicating portion that allows the first space and the second space to communicate at an end of the second space in an opposite direction to the first direction; a first stirring member that extends in the first direction within the first space and conveys the developer in the first direction while stirring; a second stirring member that is positioned within the first space between the first stirring member and the second space, extends in the first direction, and conveys the developer in the first direction while stirring; a conveyance member that extends in the first direction within the second space and conveys the developer flowing from the first communicating portion, in the opposite direction to the first direction, thereby sending the developer to the first space via the second communicating portion; and a developer support member that extends in the first direction within the second space and supports the developer being conveyed by the conveyance member, in which the main unit has a first bottom surface that faces the first stirring member and a second bottom surface that faces the second stirring member, and the first bottom surface has a bottom edge positioned higher than a bottom edge of the second bottom surface.

DETAILED DESCRIPTION OF THE PREFERRED EMBODIMENTS

Hereinafter, a development device according to an embodiment of the present invention will be described with reference to the drawings.

Configuration of Image Forming Apparatus

Figure 1:
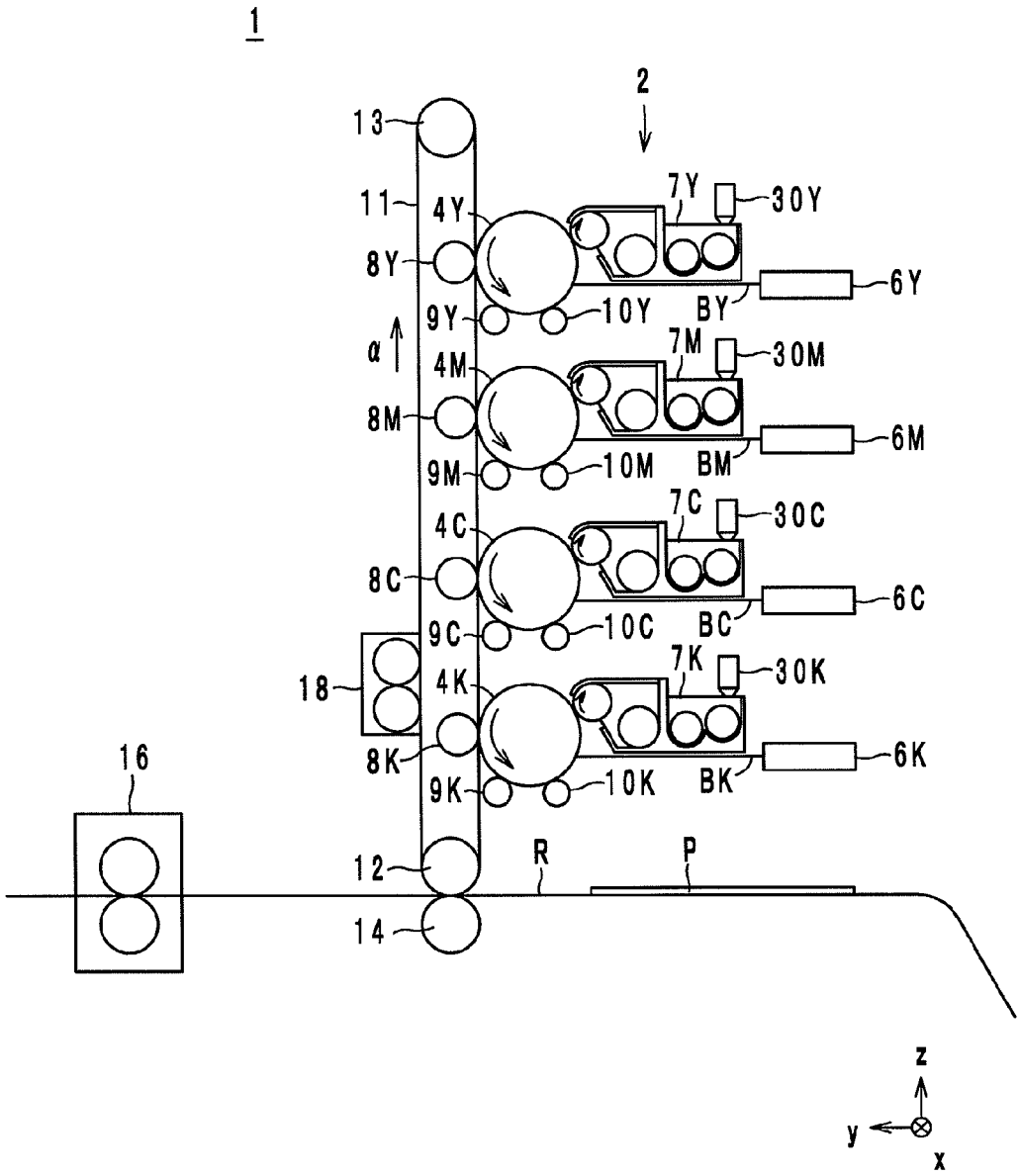
FIG. 1 is a diagram illustrating an overall configuration of an image forming apparatus.

An image forming apparatus including development devices according to an embodiment of the present invention will now be described with reference to the drawings. FIG. 1 is a view illustrating an overall configuration of the image forming apparatus 1. In the following, the vertical direction is defined as a z-axis direction, a main scanning direction as an x-axis direction, and a sub-scanning direction as a y-axis direction. The x-axis direction, the y-axis direction, and the z-axis direction are perpendicular to one another.

The image forming apparatus 1 is an electro-photographic color printer of a so-called tandem type, which is configured to synthesize images of four colors (Y: yellow, M: magenta, C: cyan, and K: black). The image forming apparatus 1 has the function of forming a toner image on paper (print medium) P on the basis of image data obtained by a scanner, and includes a conveyance path R, a printing portion 2, a fixing device 16, and a cleaning device 18, as shown in FIG. 1.

The conveyance path R is a paper feeding path along which the paper P is conveyed, and includes unillustrated conveyance rollers, guides, etc. Provided at the upstream end of the conveyance path R is an unillustrated paper feeding section. In addition, provided at the downstream end of the conveyance path R is an unillustrated paper output tray.

The printing portion 2 forms a toner image on the paper P supplied by the unillustrated paper feeding section, and includes photoreceptor drums 4 (4Y, 4M, 4C, and 4K), optical scanning devices 6 (6Y, 6M, 6C, and 6K), development devices 7 (7Y, 7M, 7C, and 7K), transfer portions 8 (8Y, 8M, 8C, and 8K), cleaners 9 (9Y, 9M, 9C, and 9K), chargers 10 (10Y, 10M, 10C, and 10K), an intermediate transfer belt 11, a drive roller 12, a driven roller 13, a secondary transfer roller 14, and hoppers 30 (30Y, 30M, 30C, and 30K).

The photoreceptor drums 4 are cylindrical and are rotated counterclockwise. The chargers 10 negatively charge the peripheries of the photoreceptor drums 4. The optical scanning devices 6 scan beams BY, BM, BC, and BK across the peripheries of the photoreceptor drums 4. The potential at portions irradiated with the beams BY, BM, BC, and BK approximates to 0V. As a result, electrostatic latent images are formed on the peripheries of the photoreceptor drums 4.

The development devices 7 apply toner to the peripheries of the photoreceptor drums 4, thereby forming toner images according to the electrostatic latent images. The configuration of the development devices 7 will be described in detail later.

The intermediate transfer belt 11 is stretched between the drive roller 12 and the driven roller 13, and receives primary transfers of the toner images developed on the photoreceptor drums 4. The transfer portions 8 are arranged so as to face the inner surface of the intermediate transfer belt 11, and, when a primary transfer voltage is applied, they provide primary transfers of the toner images formed on the photoreceptor drums 4 to the intermediate transfer belt 11. The drive roller 12 is rotated by an intermediate-transfer-belt drive portion (not shown in FIG. 1) to drive the intermediate transfer belt 11 in the direction of arrow α. As a result, the intermediate transfer belt 11 conveys the toner images to the secondary transfer roller 14.

The secondary transfer roller 14 is in contact with the intermediate transfer belt 11 and has a drum shape. The secondary transfer roller 14 provides secondary transfers of the toner images supported by the intermediate transfer belt 11 to the paper P passing between the secondary transfer roller 14 and the intermediate transfer belt 11.

The cleaning device 18 removes toner remaining on the intermediate transfer belt 11 after the secondary transfers of the toner images to the paper P.

The paper P with the secondary transfers of the toner images is conveyed to the fixing device 16. The fixing device 16 subjects the paper P to heating and pressure treatments, thereby fixing the toner images on the paper P. The paper P with the toner images fixed thereon is outputted, passing through the conveyance path R to the paper output tray.

Configuration of Development Device

Figure 2:
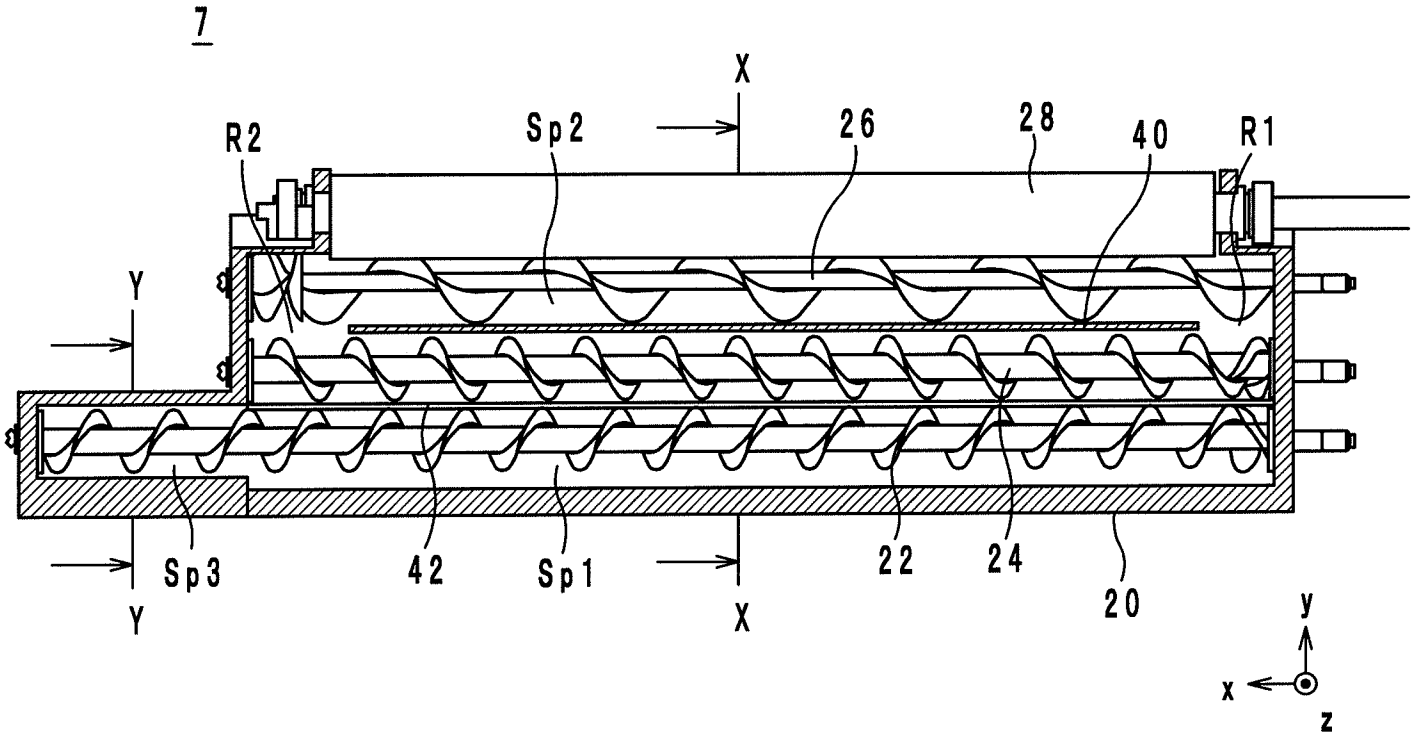
FIG. 2 is a view of a development device as seen in phantom from the positive z-axis direction side.

Next, the configuration of the development device 7 will be described with reference to the drawings. FIG. 2 is a view of the development device 7 as seen in phantom from the positive z-axis direction side. FIG. 3A is a cross-sectional view of the development device 7 along X-X of FIG. 2, and FIG. 3B is a cross-sectional view of the development device 7 along Y-Y of FIG. 2.

The development device 7 includes a main unit 20, stirring screws 22 and 24, a conveying screw 26, and a developing roller 28, as shown in FIGS. 2, 3A, and 3B.

The main unit 20 stores a developer including toner and carrier, and has a stirring space Sp1 (first space), a conveyance space Sp2 (second space), a supply space Sp3, and communicating portions R1 and R2 formed therein. The stirring space Sp1 extends in the x-axis direction. The conveyance space Sp2 is adjacent to the stirring space Sp1 and extends in the x-axis direction on the positive y-axis direction side from the stirring space Sp1. The stirring space Sp1 and the conveyance space Sp2 are divided by a partition 40, as shown in FIGS. 2 and 3A. The partition 40 is a wall which has surfaces perpendicular to the y-axis and extends in the x-axis direction.

The communicating portion R1 allows the stirring space Sp1 and the conveyance space Sp2 to communicate with each other at an end of the conveyance space Sp2 on the negative x-axis direction side. The communicating portion R2 allows the stirring space Sp1 and the conveyance space Sp2 to communicate with each other at an end of the conveyance space Sp2 on the positive x-axis direction side.

The supply space Sp3 is provided on the positive x-axis direction side from the stirring space Sp1.

The stirring screw 22 extends in the x-axis direction within the stirring space Sp1 and the supply space Sp3, and conveys the developer in the negative x-axis direction while stirring. The stirring screw 22, in planar view from the positive x-axis direction side as shown in FIG. 3A, is rotated clockwise by an unillustrated power source.

The stirring screw 24 is positioned on the positive y-axis direction side from the stirring screw 22 within the stirring space Sp1 (i.e., it is disposed within the stirring space Sp1 so as to be positioned between the stirring screw 22 and the conveyance space Sp2), and the stirring screw 24 extends in the x-axis direction, and conveys the developer in the negative x-axis direction while stirring. The stirring screw 24 is equal in diameter to the stirring screw 22. The stirring screw 24, in planar view from the positive x-axis direction side as shown in FIG. 3A, is rotated counterclockwise by an unillustrated power source.

An edge (bottom edge) of the stirring screw 22 on the negative z-axis direction side is positioned on the positive z-axis direction side from (i.e., higher than) an edge (bottom edge) of the stirring screw 24 on the negative z-axis direction side.

Here, bottom surfaces S1 and S2 in the stirring space Sp1 of the main unit 20 are shaped so as to accord with the stirring screws 22 and 24, as shown in FIG. 3A. Specifically, the bottom surface S1 faces the stirring screw 22 and is curved. The bottom surface S2 is positioned on the positive y-axis direction side from the bottom surface S1 so as to face the stirring screw 24, and is curved. In addition, an edge (bottom edge) of the bottom surface S1 on the negative z-axis direction side is positioned higher than an edge (bottom edge) of the bottom surface S2 on the negative z-axis direction side. Moreover, line L, which extends between the (bottom) edge of the bottom surface S1 on the negative z-axis direction side and the (bottom) edge of the bottom surface S2 on the negative z-axis direction side, makes angle θ to the xy-plane (horizontal plane). Furthermore, the boundary between the bottom surfaces S1 and S2 projects in the positive z-axis direction, forming an elongated protrusion 42. The elongated protrusion 42 extends in the x-axis direction between the stirring screws 22 and 24, as shown in FIG. 2.

The stirring screws 22 and 24 thus configured are rotated clockwise and counterclockwise, respectively, so that the developer is stirred clockwise and counterclockwise along the bottom surfaces S1 and S2. The developer being stirred along the bottom surfaces S1 and S2 has its flows merged at the elongated protrusion 42 and is further stirred. As a result, the toner in the developer is charged.

The conveying screw 26 extends in the x-axis direction within the conveyance space Sp2, and conveys the developer flowing in from the communicating portion R1, in the positive x-axis direction, thereby sending the developer to the stirring space Sp1 via the communicating portion R2. The conveying screw 26, in planar view from the positive x-axis direction side as shown in FIG. 3A, is rotated clockwise by an unillustrated power source.

The developing roller 28 is a developer support which is positioned on the positive y-axis direction side from the conveying screw 26 within the conveyance space Sp2, extends in the x-axis direction, and supports the developer being conveyed by the conveying screw 26. More specifically, the developing roller 28 includes a magnet 28*a* and a sleeve 28*b*. The sleeve 28*b* is a nonmagnetic metal cylinder, and faces the photoreceptor drum 4. The sleeve 28*b* is rotated in an opposite direction (i.e., clockwise) to the photoreceptor drum 4.

The magnet 28*a* is provided inside the sleeve 28*b*, and has magnetic poles N1, S1, N2, N3, and S2, as shown in FIG. 3A. The magnetic pole N1 faces the photoreceptor drum 4. In addition, the magnetic poles N1, S1, N2, N3, and S2 are arranged on the magnet 28*a* in this order, clockwise. The magnet 28*a* adsorbs the carrier in the developer, thereby holding the developer on the periphery of the sleeve 28*b*.

In the developing roller 28 thus configured, the carrier is adsorbed on the periphery of the sleeve 28*b* by a magnetic field between the magnetic poles N3 and S1. At this time, the toner adhering to the carrier is also adsorbed on the sleeve 28*b*. Specifically, the developer is adsorbed on the periphery of the sleeve 28*b*, and conveyed through rotation of the sleeve 28*b*. During this, the developer is held on the periphery of the sleeve 28*b* by a magnetic field between the magnetic poles S1 and N1. The toner in the developer is moved from the sleeve 28*b* to the photoreceptor drum 4 by an electric field created between the photoreceptor drum 4 and the sleeve 28*b*. Specifically, a toner image is developed on the periphery of the photoreceptor drum 4.

Moreover, after passing between the photoreceptor drum 4 and the sleeve 28*b*, the developer is conveyed while being held on the sleeve 28*b* by magnetic fields between the magnetic poles N1 and S2 and between the magnetic poles S2 and N2. Thereafter, the developer is separated from the sleeve 28*b* by a magnetic field between the magnetic poles N2 and N3.

Furthermore, the hopper 30 is connected to the supply space Sp3 on the positive z-axis direction side, as shown in FIG. 3B, and supplies the supply space Sp3 with the toner. More specifically, the image forming apparatus 1 includes an unillustrated control portion and sensing portion. The sensing portion is a magnetic permeability sensor that senses a toner concentration in the development device 7. The toner concentration is a weight ratio of the toner in the developer. The control portion causes the hopper 30 to supplement the toner to the development device 7 when the toner concentration sensed by the sensing portion is lower than a predetermined value. Note that the amount of toner to be supplemented is determined by the control portion on the basis of the toner concentration sensed by the sensing portion, image information upon image formation, etc.

Regarding Developer

Next, the developer will be described. The developer includes toner and carrier that charges the toner. As the toner, a generally used toner can be used, which contains a colorant in binder resin, along with a charge control agent and a release agent as necessary, and is treated with an additive. The particle size of the toner is, for example, from 3 μm to 15 μm.

The toner as described above can be produced by a general production method, such as grinding, emulsion polymerization, or suspension polymerization.

Examples of the binder resin used in the toner include styrene resin (a homopolymer or copolymer containing styrene or a styrene substitute), polyester resin, epoxy resin, vinyl chloride resin, phenolic resin, polyethylene resin, polypropylene resin, polyurethane resin, and silicone resin. These examples of resin can be used alone or as composites, and preferably have a softening temperature in the range from 80° C. to 160° C. or a glass transition point in the range from 50° C. to 75° C.

Moreover, as the colorant, a generally used, known colorant can be used, examples of which include carbon black, aniline black, activated carbon, magnetite, benzine yellow, permanent yellow, naphthol yellow, phthalocyanine blue, fast sky blue, ultramarine blue, rose bengal, and lake red, and such a colorant is preferably used at a ratio of 2 to 20 parts by weight to 100 parts by weight of the binder resin.

Furthermore, as the charge control agent, a generally used agent can be used. Examples of positively chargeable toner charge control agents are nigrosine dyes, quaternary ammonium salt compounds, triphenylmethane compounds, imidazole compounds, and polyamine resin. Examples of negatively chargeable toner charge control agents are azo dyes containing metals such as Cr, Co, Al, and Fe, salicylic acid metal compounds, alkylsalicylic acid metal compounds, and calixarene compounds. In general, the charge control agent is preferably used at a ratio of 0.1 to 10 parts by weight to 100 parts by weight of the binder resin.

Further still, as the release agent, a generally used agent can be used, and for example, polyethylene, polypropylene, carnauba wax, and sasolwax can be used alone or in combination of two or more. In general, the release agent is preferably used at a ratio of 0.1 to 10 parts by weight to 100 parts by weight of the binder resin.

Further yet, as the particles to be added to the toner, generally used particles can be used, and to improve liquidity, for example, silica, titanium oxide, or aluminum oxide is used. In particular, particles provided with water repellency by a silane coupling agent, a titanate coupling agent, or silicone oil are preferably used. Such a fluidizer is preferably added at a ratio of 0.1 to 5 parts by weight to 100 parts by weight of the toner.

As the carrier, a generally used carrier can be used, examples of which are binder-type and coat-type carriers. The particle size of the carrier is, for example, from 15 μm to 100 μm.

The binder-type carrier has magnetic particulates dispersed in binder resin, and it can have positively or negatively chargeable particulates adhering to the carrier surface or can have a surface-coating layer provided thereon. Charging characteristics of the binder-type carrier, including, for example, the polarity, can be controlled in accordance with the material of the binder resin, the type of the chargeable particulates, the type of the surface-coating layer, etc.

Examples of the binder resin to be used in the binder-type carrier include vinyl resin as typified by polystyrene resin, thermoplastic resin such as polyester resin, nylon resin, and polyolefin resin, and thermosetting resin such as phenolic resin.

Usable as the magnetic particulates in the binder-type carrier are particles of spinel ferrites such as magnetite and gamma-ferric oxide, spinel ferrites containing one or more than one metals (e.g., Mn, Ni, Mg, and Cu) other than iron, magnetoplumbite ferrites such as barium ferrite, and iron or alloy particles with ferric oxide on their surfaces. The shape may be granular, spherical, or acicular. Particularly in the case where high magnetization is required, iron-based ferromagnetic particulates are preferably used. Moreover, in consideration of scientific stability, ferromagnetic particulates of spinel ferrites, including magnetite, gamma-ferric oxide, etc., and magnetoplumbite ferrites such as barium ferrite are preferably used. By appropriately selecting the type and the contained amount of ferromagnetic particulates, it is rendered possible to obtain a magnetic resin carrier with desired magnetization. The magnetic particulates are properly added at 50 to 90 percent by weight of the magnetic resin carrier.

As the surface coating material for the binder-type carrier, silicone resin, acrylic resin, epoxy resin, fluoroplastic, etc., can be used, and these resins are used to coat surfaces and hardened to form coat layers, thereby enhancing charge application ability.

Chargeable or conductive particulates can be caused to adhere to the binder-type carrier surface by, for example, homogeneously mixing the particulates in the magnetic resin carrier, thereby attaching the particulates to the magnetic resin carrier surface, and thereafter applying mechanical/thermal impact to the surface, thereby embedding and fixing the particulates in the magnetic resin carrier. In this case, the particulates are fixed so as to partially protrude from the magnetic resin carrier surface without completely being buried in the magnetic resin carrier. As the chargeable particulates, organic or inorganic insulating materials can be used. Specific examples of the organic insulating material that can be used are organic insulating particulates of polystyrene, styrene copolymer, acrylic resin, various acrylic copolymers, nylon, polyethylene, polypropylene, fluoroplastic, and cross-linking products thereof, and their charge levels and polarities can be controlled as desired in accordance with selected materials and polymerization catalysts, surface treating, etc. Examples of the inorganic insulating material include negatively chargeable inorganic particulates such as silica and titanium dioxide, and positively chargeable inorganic particulates such as strontium titanate and alumina.

On the other hand, the coat-type carrier is a carrier having magnetic carrier core particles coated with resin, and similar to the binder-type carrier, the coat-type carrier can have positively or negatively chargeable particulates adhering to the carrier surface. Charging characteristics of the coat-type carrier, including, for example, the polarity, can be controlled in accordance with the type of the surface-coating layer and the type of the chargeable particulates, and the same material as the binder-type carrier can be used. In particular, the same resin as the binder resin of the binder-type carrier can be used as the coat resin.

In a combination of opposite polarity particles, toner, and carrier, the charge polarities of the toner and the opposite polarity particles can be readily known from the direction of the electric field by which to separate the toner or the opposite polarity particles from a developer obtained by mixing and stirring the opposite polarity particles, the toner, and the carrier.

The mixing ratio of the toner to the carrier may be adjusted such that a desired amount of charge can be achieved for the toner, and an appropriate percentage of the toner is 3 to 30 percent by weight, preferably, 4 to 20 percent by weight, of the total amount of the toner and the carrier.

First Modification

Figure 4:
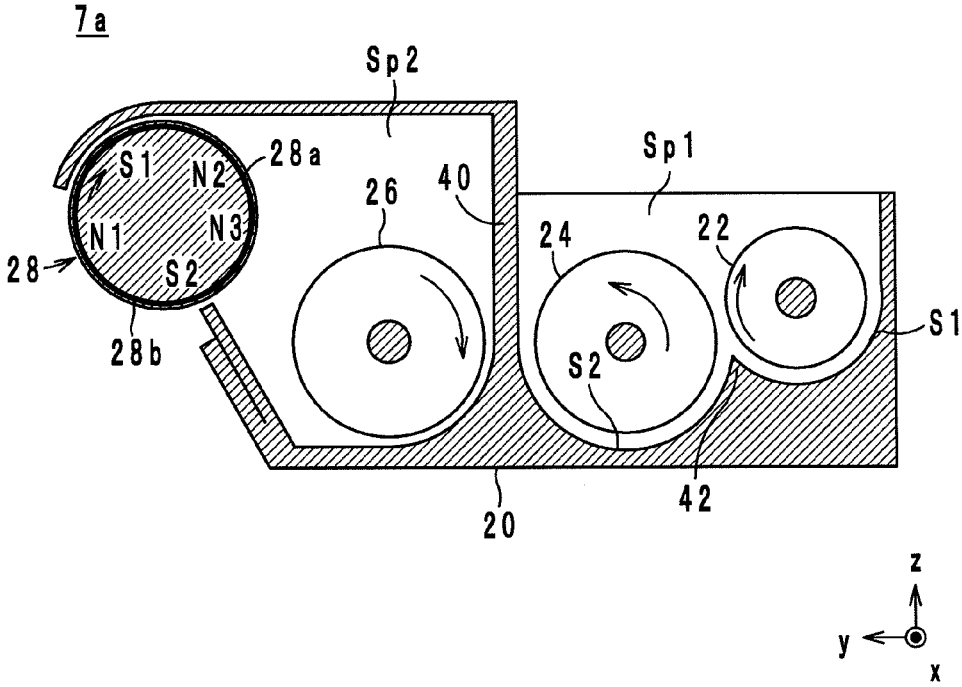
FIG. 4 is a cross-sectional view of a development device according to a first modification.

Next, a development device according to a first modification will be described with reference to the drawings. FIG. 4 is a cross-sectional view of the development device 7*a* according to the first modification.

As in the development device 7*a* shown in FIG. 4, the stirring screw 22 may have a smaller diameter than the stirring screw 24.

Second Modification

Figure 5:
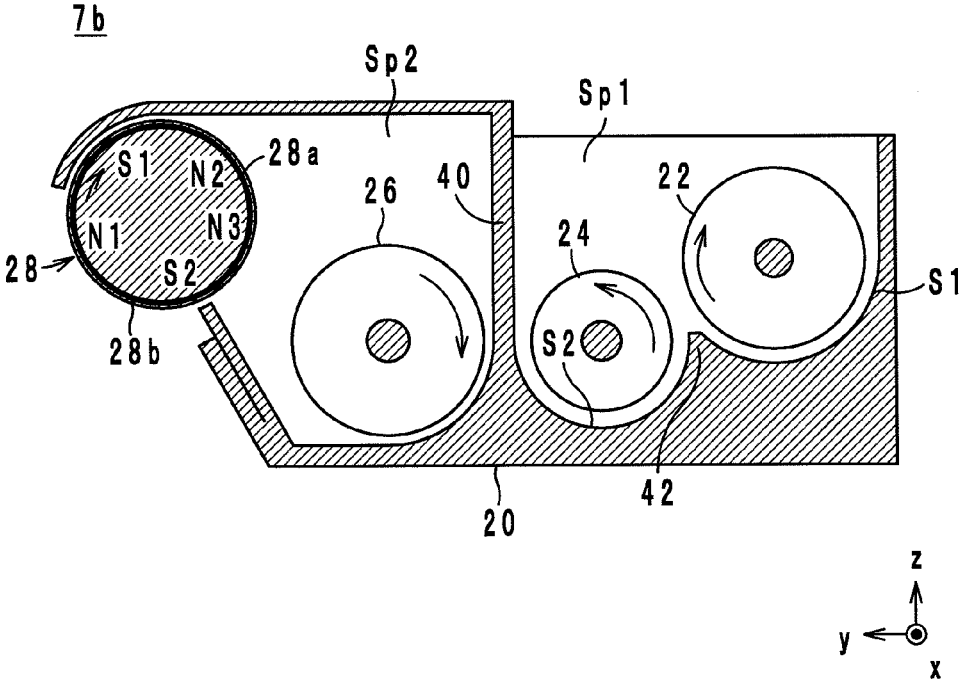
FIG. 5 is a cross-sectional view of a development device according to a second modification.

Next, a development device according to a second modification will be described with reference to the drawings. FIG. 5 is a cross-sectional view of the development device 7*b* according to the second modification.

As in the development device 7*b* shown in FIG. 5, the stirring screw 22 may have a larger diameter than the stirring screw 24.

Effects

The development devices 7, 7*a*, and 7*b* thus configured inhibit uneven density from occurring in toner images. More specifically, in the development device 500 described in Japanese Patent Laid-Open Publication No. 2011-2760, the amount of developer flowing from the communicating portion R11 to the developer supply and recovery portion Sp12 might become insufficient. In such a case, a sufficient amount of developer can be supported in the vicinity of the end of the developing roller 510 on the positive x-axis direction side but cannot be supported in the vicinity of the end of the developing roller 510 on the negative x-axis direction side. As a result, uneven density might occur in a toner image developed on the photoreceptor by the developing roller 510.

On the other hand, in the development devices 7, 7*a*, and 7*b*, the (bottom) edge of the bottom surface S1 on the negative z-axis direction side is positioned higher than the (bottom) edge of the bottom surface S2 on the negative z-axis direction side. Accordingly, the developer flows in the positive y-axis direction while gravitationally falling in the negative z-axis direction at the end of the stirring space Sp1 on the negative x-axis direction side. In addition, the developer flows into the conveyance space Sp2 via the communicating portion R1. As a result, the amount of developer flowing into the conveyance space Sp2 is prevented from being insufficient, so that a sufficient amount of developer can be supported in the vicinity of an end of the developing roller 28 on the positive x-axis direction side, as in the vicinity of an end of the developing roller 28 on the negative x-axis direction side. Thus, it is possible to inhibit occurrence of uneven density where the density of the toner image decreases in the direction from the negative to the positive x-axis direction side.

First Experiment

Figure 6:
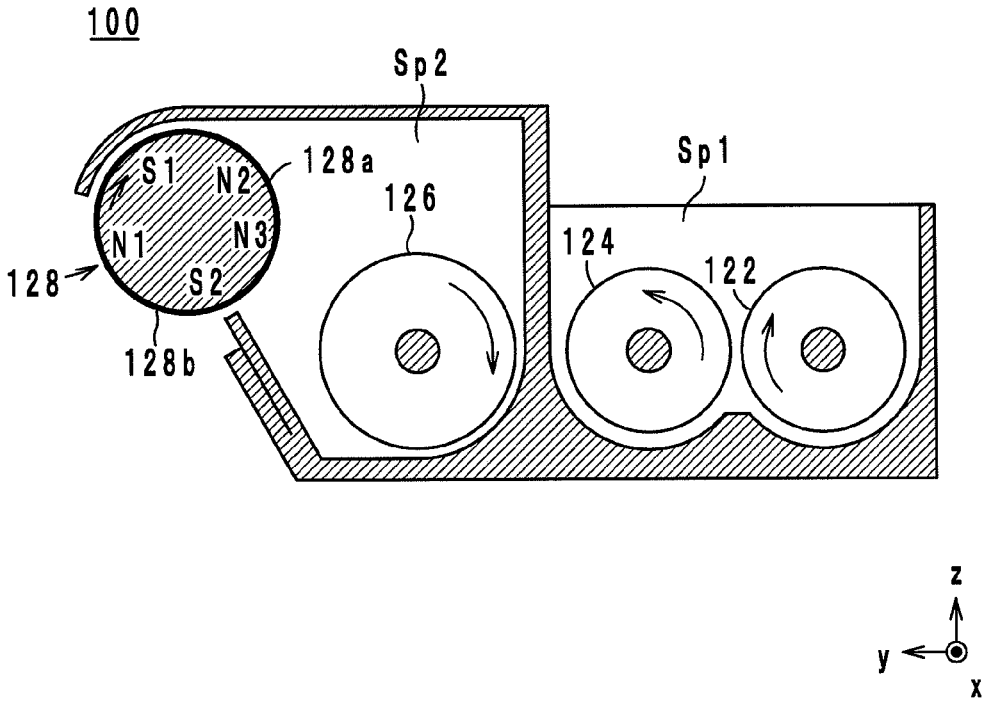
FIG. 6 is a cross-sectional view of a development device in a comparative example.
Figure 7:
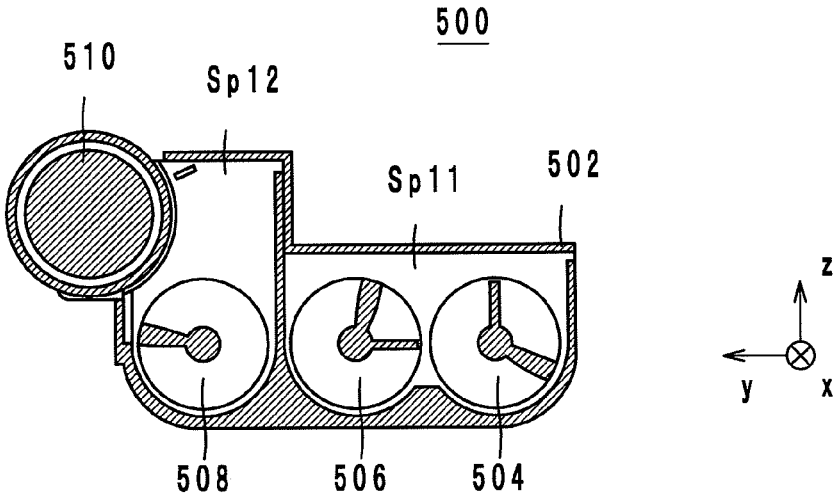
FIG. 7 is a cross-sectional view of a development device described in Japanese Patent Laid-Open Publication No. 2011-2760.
Figure 8:
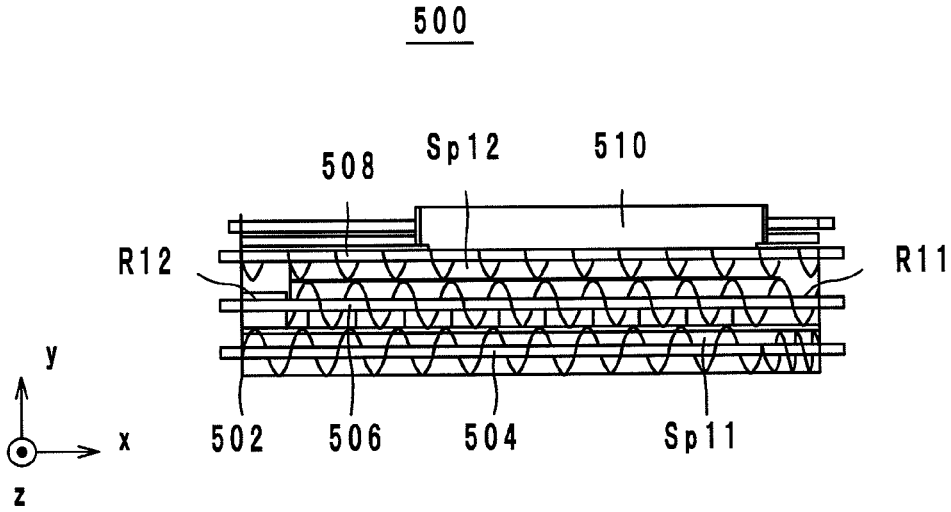
FIG. 8 is a top view of the development device described in Japanese Patent Laid-Open Publication No. 2011-2760.

To better clarify the effects achieved by the development devices 7, 7*a*, and 7*b*, the present inventor conducted First Experiment to be described below. Specifically, Examples 1 through 6 and Comparative Example were produced with their structures as shown in Table 1 below. Table 1 is a table showing the structures of Examples 1 through 6 and Comparative Example. FIG. 6 is a cross-sectional view of a development device 100 in Comparative Example.

TABLE 1

| | Diameter of Conveying Screw 26 (mm) | Diameter of Stirring Screw 22 (mm) | Diameter of Stirring Screw 24 (mm) | θ (°) |
|---|---|---|---|---|
| Example 1 | 30 | 25 | 25 | 10 |
| Example 2 | 30 | 25 | 25 | 5 |
| Example 3 | 30 | 25 | 25 | 15 |
| Example 4 | 30 | 25 | 25 | 20 |
| Example 5 | 30 | 22 | 28 | 20 |
| Example 6 | 30 | 28 | 22 | 20 |
| Com. Example | 30 | 25 | 25 | 0 |

Figure 3:
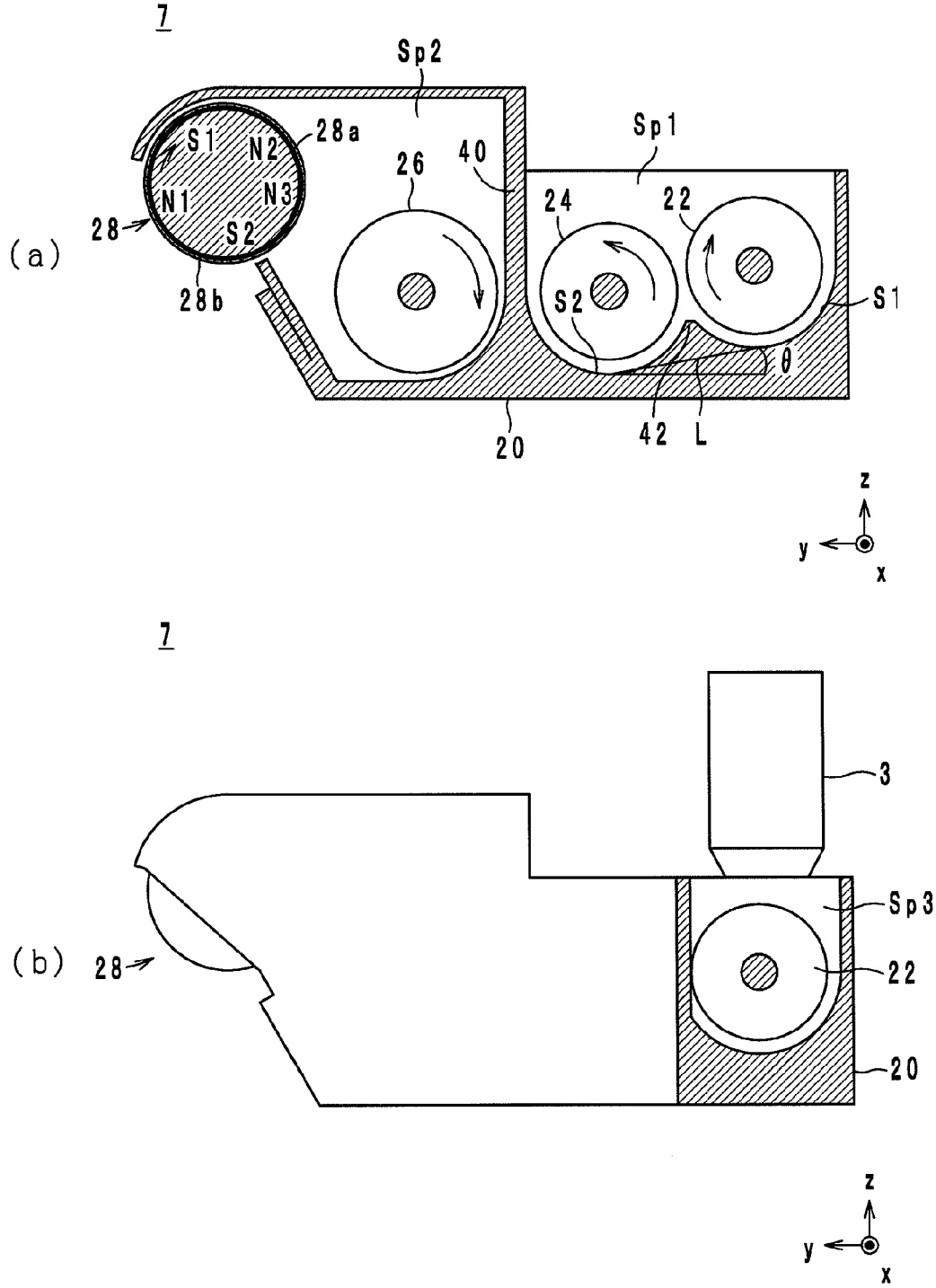
FIGS. 3 A and 3B are cross-sectional views of the development device along X-X and Y-Y, respectively, of FIG. 2.

Examples 1 through 4 used the development devices 7 with the structure of FIG. 3 but varied angles θ. Example 5 used the development device 7*a* with the structure of FIG. 4. Example 6 uses the development device 7*b* with the structure of FIG. 5.

First Experiment used developer A with carrier particle size 35 μm, toner particle size 6 μm, and toner concentration 7%.

The present inventor studied whether uneven density occurred in toner images by rotating the stirring screws 22 and 24 and the conveying screw 26 in Examples and Comparative Example at rotating speeds in Table 2 below, under the conditions described above. The uneven density refers to the density of a toner image decreasing in the direction from the negative to the positive x-axis direction side. The present inventor visually determined whether or not uneven density occurred using solid images. Table 2 is a table showing conditions (rotating speeds) and experimental results. In addition, the printing speed was 150 pages per minute.

TABLE 2

| | Rotating Speed of Conveying Screw 26 (rpm) | Rotating Speed of Stirring Screw 22 (rpm) | Rotating Speed of Stirring Screw 24 (rpm) | Density Unevenness |
|---|---|---|---|---|
| Example 1 | 500 | 500 | 500 | Observed |
| | | 520 | 520 | Observed |
| | | 540 | 540 | Observed |
| | | 560 | 560 | Observed |
| | | 580 | 580 | Observed |
| | | 600 | 600 | Not Observed |
| Example 2 | | 720 | 720 | Observed |
| | | 740 | 740 | Observed |
| | | 760 | 760 | Not Observed |
| Example 3 | | 560 | 560 | Observed |
| | | 580 | 580 | Not Observed |
| | | 600 | 600 | Not Observed |
| Example 4 | | 540 | 540 | Observed |
| | | 560 | 560 | Not Observed |
| | | 580 | 580 | Not Observed |
| Example 5 | | 580 | 580 | Observed |
| | | 600 | 600 | Not Observed |
| | | 620 | 620 | Not Observed |
| Example 6 | | 480 | 480 | Observed |
| | | 500 | 500 | Not Observed |
| | | 520 | 520 | Not Observed |

TABLE 2-continued

| | Rotating Speed of Conveying Screw 26 (rpm) | Rotating Speed of Stirring Screw 22 (rpm) | Rotating Speed of Stirring Screw 24 (rpm) | Density Unevenness |
|---|---|---|---|---|
| Comp. Example | | 500 | 500 | Observed |
| | | 600 | 600 | Observed |
| | | 700 | 700 | Observed |
| | | 760 | 760 | Observed |
| | | 780 | 780 | Observed |
| | | 800 | 800 | Not Observed |

According to Table 2, in Examples, uneven density did not occur in toner images where the rotating speeds of the stirring screws 22 and 24 were in the range from 500 rpm to 760 rpm. On the other hand, in Comparative Example, uneven density occurred in toner images unless the rotating speeds of the stirring screws 122 and 124 were 800 rpm or more. That is, it can be appreciated that Examples are resistant to uneven density in toner images even if the rotating speeds of the stirring screws 22 and 24 are lower than in Comparative Example. The reason for this is that in Examples, the developer is conveyed by the stirring screws 22 and 24 to flow from the communicating portion R1 into the conveyance space Sp2 with additional assistance of gravity, so that a sufficient amount of developer is supplied to the conveyance space Sp2.

Furthermore, when comparing Examples 1 through 4, it can be appreciated that as angle θ increases, the rotating speed at which uneven density starts not to occur decreases. This is assumed to be due to the principle that the larger angle θ, the more developer gravitationally flows from the communicating portion R1 into the conveyance space Sp2. It can also be appreciated from Tables 1 and 2 that the rotating speed at which uneven density starts not to occur significantly decreases when angle θ changes from 5° (Example 2) to 10° (Example 1). Thus, angle θ is preferably 10° or more.

The stirring screw 22 positioned on the positive z-axis direction side from the stirring screw 24 is simply designed to have a central axis positioned on the negative z-axis direction side from the positive z-axis direction-side edge of the stirring screw 24 positioned on the negative z-axis direction side. Accordingly, angle θ is simply smaller than in the case where the central axis of the stirring screw 22 positioned on the positive z-axis direction side is disposed at the same position in the z-axis direction as the positive z-axis direction-side edge of the stirring screw 24 positioned on the negative z-axis direction side.

Next, the present inventor made four types of evaluations of Examples and Comparative Example, regarding conditions under which no uneven density occurred in toner images, as will be described below. Note that, for each example, where no uneven density occurred in toner images under more than one condition, evaluations were made for the condition with the lowest rotating speed. Moreover, the printing speed was 150 pages per minute.

Evaluation 1 was made regarding the degree of wear on bearings of the stirring screws 22, 24, 122, and 124. Evaluation 2 was made regarding the amount of developer to be stored in the main unit 20. Evaluation 3 was made regarding the degree of fogging on backgrounds (hereinafter, referred to as background portions) of toner images. Evaluation 4 was made regarding the quality of toner images after printing 1,000,000 pages. Table 3 is a table showing evaluation results.

TABLE 3

| | Rotating Speed of Conveying Screw 26 (rpm) | Rotating Speed of Stirring Screw 22 (rpm) | Rotating Speed of Stirring Screw 24 (rpm) | Evaluation 1 | Evaluation 2 | Evaluation 3 | Evaluation 4 |
|---|---|---|---|---|---|---|---|
| Example 1 | 500 | 600 | 600 | 4 | 5 | 5 | 4 |
| Example 2 | | 760 | 760 | 6 | 6 | 6 | 6 |
| Example 3 | | 580 | 580 | 3 | 4 | 4 | 3 |
| Example 4 | | 560 | 560 | 2 | 1 | 3 | 2 |
| Example 5 | | 600 | 600 | 4 | 3 | 1 | 4 |
| Example 6 | | 500 | 500 | 1 | 2 | 2 | 1 |
| Comp. Example | | 800 | 800 | 7 | 7 | 7 | 7 |

In Table 3, for each evaluation, 1 through 7 indicate ranking. Note that lower numbers mean better evaluation results.

From Evaluation 1, it can be appreciated that lower rotating speeds bring about better results. This means that as the rotating speeds of the stirring screws 22, 24, 122, and 124 decrease, the bearings of the stirring screws 22, 24, 122, and 124 become less susceptible to wear. In addition, for Evaluation 1, it can be appreciated from Table 3 that Examples 1 through 6 had better results than Comparative Example. Thus, from Evaluation 1, it can be appreciated that the development devices 7, 7*a*, and 7*b* have enhanced durability compared to the development device 100.

For Evaluation 2, it can be appreciated from Table 3 that Examples 1 through 6 had better results than Comparative Example. Therefore, according to Evaluation 2, the development devices 7, 7*a*, and 7*b* require a smaller amount of developer to be stored in the main unit 20 than the development device 100. Thus, production cost for the development devices 7, 7*a*, and 7*b* can be reduced.

Evaluation 3 was made regarding the degree of fogging in background portions. Fogging occurs in the background portion when the developer is not sufficiently charged. Specifically, for Examples 1 through 6 and Comparative Example, Evaluation 3 was made regarding whether the developer was sufficiently stirred. It can be appreciated from Table 3 that Examples 1 through 6 had better results than Comparative Example. Thus, it can be appreciated that the development devices 7, 7*a*, and 7*b* can more sufficiently stir the developer than the development device 100.

Moreover, for the following reason, Examples 5 and 6 had better results than Examples 1 through 4. The stirring screw 24 of Example 5 and the stirring screw 22 of Example 6 have larger diameters than the stirring screws 22 and 24 of Examples 1 through 4. Therefore, according to Table 3, the developer was more sufficiently stirred in Examples 5 and 6 than in Examples 1 through 4, so that less fogging occurs in the background portion.

Furthermore, according to Table 3, Example 5 had a better result for Evaluation 3 than Example 6 for the following reasons. In Example 6, the stirring screw 22 is provided in a more distant position from the conveying screw 26 than the stirring screw 24, and has a larger diameter than the stirring screw 24. Thus, the stirring screw 22 conveys a greater amount of developer than the stirring screw 24.

On the other hand, in Example 5, the stirring screw 22 is provided in a more distant position from the conveying screw 26 than the stirring screw 24, and has a smaller diameter than the stirring screw 24. Thus, the stirring screw 22 conveys a smaller amount of developer than the stirring screw 24.

Here, the developer conveyed by the stirring screw 22 flows into the conveyance space Sp2 via the communicating portion R1 after being stirred while passing the stirring screw 24. Accordingly, in Example 6, when the developer flows into the conveyance space Sp2 via the communicating portion R1, a greater amount of developer is stirred while passing the stirring screw 24 than in Example 5. Therefore, a greater amount of developer is stirred by the stirring screws 22 and 24 in Example 6 than in Example 5. Thus, similar to Example 5, Example 6 can more effectively inhibit fogging from occurring in the background portion.

Evaluation 4 was made regarding the quality of toner images (solid images) through visual inspection of the contrast of the toner images. Evaluation 4 resulted the same as in Evaluation 1, as shown in Table 3. That is, for Evaluation 4, lower rotating speeds brought about better results. The reason for this is that as the rotating speeds of the stirring screws 22 and 24 decrease, heat generation at the bearings of the stirring screws 22 and 24 is suppressed, so that the developer is prevented from deteriorating due to heat. Thus, it can be appreciated from Evaluation 4 that the development devices 7, 7*a*, and 7*b* can achieve more superior image quality than the development device 100.

Second Experiment

The present inventor further conducted Second Experiment to be described below. Concretely, Examples 7 through 9 were produced with their structures as shown in Table 4 below. Table 4 is a table showing the structures of Examples 7 through 9.

TABLE 4

| | Diameter of Conveying Screw 26 (mm) | Diameter of Stirring Screw 22 (mm) | Diameter of Stirring Screw 24 (mm) | θ (°) |
|---|---|---|---|---|
| Example 7 | 25 | 20 | 25 | 20 |
| Example 8 | 25 | 20 | 23 | 20 |
| Example 9 | 30 | 22 | 28 | 20 |

The present inventor operated Examples 7 through 9 under the conditions shown in Table 5, and studied whether uneven density and fogging in the background portion occurred. Developers used in Second Experiment were developer A mentioned earlier, and developer B with carrier particle size 50 μm, toner particle size 8 μm, and toner concentration 8%. Table 5 is a table showing conditions (rotating speeds) and experimental results.

TABLE 5

| | Rotating Speed of Conveying Screw 26 (rpm) | Rotating Speed of Stirring Screw 22 (rpm) | Rotating Speed of Stirring Screw 24 (rpm) | Printing Speed (sheets/min) | Developer | Density Unevenness | Fogging |
|---|---|---|---|---|---|---|---|
| Example 7 | 500 | 500 | 500 | 100 | Developer A | Not Observed | Not Observed |
| Example 8 | 500 | 500 | 500 | 100 | Developer A | Not Observed | Not Observed |
| | 750 | 750 | 750 | 150 | Developer A | Not Observed | Not Observed |
| Example 9 | 500 | 500 | 500 | 150 | Developer B | Not Observed | Not Observed |

It can be appreciated from Example 7 that, when the printing speed is relatively low at 100 pages per minute, the amount of developer required is small so that the diameter of the stirring screw 22 can be reduced.

For Example 8, the experiment was carried out while changing the speeds of the stirring screws 22 and 24 and the conveying screw 26, resulting in neither uneven density nor fogging under any of the conditions.

Example 9 used developer B in place of developer A, resulting in neither uneven density nor fogging.

Although the present invention has been described in connection with the preferred embodiment above, it is to be noted that various changes and modifications are possible to those who are skilled in the art. Such changes and modifications are to be understood as being within the scope of the invention.

What is claimed is:

1. A development device comprising:

a main unit having a developer stored therein and having formed therein:

a first space extending in a longitudinal direction of the main unit, a second space that is adjacent to the first space in a direction perpendicular to the longitudinal direction and that extends in the longitudinal direction of the main unit, a first communicating portion that is formed at a first end side of the main unit in the longitudinal direction and that allows the first space and the second space to communicate at the first end side, and a second communicating portion that is formed at a second end side of the main unit in the longitudinal direction opposite to the first end side and that allows the first space and the second space to communicate at the second end side;

a first stirring member that extends in the longitudinal direction within the first space and that conveys the developer in the longitudinal direction from the second end side of the main unit toward the first end side while stirring;

a second stirring member that is positioned within the first space between the first stirring member and the second space, that extends in the longitudinal direction, and that conveys the developer in the longitudinal direction from the second end side of the main unit toward the first end side while stirring;

a conveyance member that extends in the longitudinal direction within the second space and that conveys the developer flowing in from the first communicating portion, in the longitudinal direction from the first end side of the main unit toward the second end side, thereby sending the developer back to the first space via the second communicating portion; and a developer support member that extends in the longitudinal direction within the second space and that supports the developer being conveyed by the conveyance member, wherein, the main unit has a first bottom surface that faces the first stirring member and a second bottom surface that faces the second stirring member, and the first bottom surface has a bottom edge positioned higher than a bottom edge of the second bottom surface, wherein a boundary between the first bottom surface and the second bottom surface projects from a bottom surface of the first space to form an elongated protrusion that continuously extends in the longitudinal direction from the first end side of the main unit to the second end side between the first stirring member and the second stirring member, and wherein a to edge of the elongated protrusion is positioned lower than a central rotational axis of the first stirring member.

2. The development device according to claim 1, wherein a line extending between the bottom edge of the first bottom surface and the bottom edge of the second bottom surface makes an angle of 10° or more to a horizontal plane.

3. The development device according to claim 1, wherein the first stirring member and the second stirring member are screws, and the first stirring member has a larger diameter than the second stirring member.

4. The development device according to claim 1, wherein the first stirring member and the second stirring member are screws, and the second stirring member has a larger diameter than the first stirring member.

5. The development device according to claim 1, wherein the central rotational axis of the first stirring member is positioned lower than a top edge of the second stirring member.

6. The development device according to claim 1, wherein the first stirring member and the second stirring member rotate to convey the developer from the bottom upward on a side where the first and second stirring members face each other.

7. The development device according to claim 1, wherein the top edge of the elongated protrusion is positioned lower than a central rotational axis of the second stirring member.

8. The development device according to claim 1, wherein a line extending between the bottom edge of the first bottom surface and the bottom edge of the second bottom surface makes an angle of 15° or more to a horizontal plane.

9. The development device according to claim 1, wherein a line extending between the bottom edge of the first bottom surface and the bottom edge of the second bottom surface makes an angle of 20° or more to a horizontal plane.

10. The development device according to claim 1, wherein the main unit has further formed therein a supply space which is provided at an end side of the first space in the longitudinal direction such that the first stirring member extends in the longitudinal direction within both the first space and the supply space, and the first stirring member conveys the developer from the supply space in the longitudinal direction from the second end side of the main unit toward the first end side while stirring.

11. The development device according to claim 1, wherein the first stirring member is configured to rotate in a clockwise direction.

12. The development device according to claim 11, wherein the second stirring member is configured to rotate in a counterclockwise direction.

13. The development device according to claim 12, wherein the first and second stirring members are configured to rotate so that the developer being stirred in the first space along the first and second bottom surfaces has its flows merged at the elongated protrusion and is further stirred and conveyed in the longitudinal direction from the second end side of the main unit toward the first end side while stirring and caused to flow out from the first space to the second space via the first communicating portion.

14. The development device according to claim 13, wherein the conveyance member is configured to rotate in the clockwise direction so that the developer flowing into the second space from the first communicating portion is conveyed in the longitudinal direction from the first end side of the main unit toward the second end side, thereby sending the developer back to the first space via the second communicating portion.

15. The development device according to claim 1, wherein the main unit further has a partition wall that continuously extends in the longitudinal direction from the first communicating portion to the second communicating portion between the second stirring member and the conveyance member, wherein the partition wall divides the main unit and defines the first space and the second space, and wherein an opening formed between a first end of the partition wall in the longitudinal direction and an end wall of the main unit defines the first communicating portion, and an opening formed between a second end of the partition wall in the longitudinal direction and another end wall of the main unit defines the second communicating portion.

* * * * *